US008221521B2

(12) United States Patent
Bruce

(10) Patent No.: US 8,221,521 B2
(45) Date of Patent: Jul. 17, 2012

(54) METHOD OF DEGASSING MOLTEN METAL

(75) Inventor: Simon Harold Bruce, East Grinstead (GB)

(73) Assignee: Edwards Limited, Crawley, West Sussex (GB)

( * ) Notice: Subject to any disclaimer, the term of this patent is extended or adjusted under 35 U.S.C. 154(b) by 0 days.

(21) Appl. No.: 12/879,435

(22) Filed: Sep. 10, 2010

(65) Prior Publication Data

US 2011/0107873 A1 May 12, 2011

Related U.S. Application Data

(62) Division of application No. 11/793,749, filed on Jun. 20, 2007, now Pat. No. 7,815,845.

(30) Foreign Application Priority Data

Dec. 20, 2004 (GB) ..... 0427832.1

(51) Int. Cl.
*C21C 7/10* (2006.01)

(52) U.S. Cl. ..... 75/508; 75/582

(58) Field of Classification Search ..... None
See application file for complete search history.

(56) References Cited

U.S. PATENT DOCUMENTS 4,604,137 A * 8/1986 Yamada ..... 75/512
2006/0048913 A1* 3/2006 Mizuno et al. ..... 164/337

* cited by examiner

*Primary Examiner* — George Wyszomierski

(57) ABSTRACT

To degas a molten metal, a receptacle containing the molten metal and a layer of slag over the molten metal is positioned in a chamber, and the chamber is evacuated. As the pressure in the chamber reduces, gas is generated at the interface between the molten metal and the slag, which causes the slag to foam. To inhibit overflowing of slag from the receptacle, a gauge outputs a signal indicative of the level of the surface of the slag, and the rate of evacuation of the chamber is reduced to reduce the rate of gas generation.

7 Claims, 4 Drawing Sheets

METHOD OF DEGASSING MOLTEN METAL

CROSS REFERENCE TO RELATED APPLICATIONS

This is a divisional application of application Ser. No. 11/793,749 filed Jun. 20, 2007, now U.S. Pat. No. 7,815,845.

BACKGROUND OF THE INVENTION

The present invention relates to apparatus for and a method of degassing molten metal, in particular molten steel.

Purification of molten metal, especially molten steel, by subjecting the molten metal to a vacuum has been known for some time. In such a process, the molten metal is poured into an open receptacle, or "ladle", and covered with a layer of fused (liquid) mineral slag, which both insulates and isolates the molten metal, and is chemically formulated to aid the purification process. The ladle is positioned within a degassing chamber connected to a vacuum pumping arrangement for evacuating the chamber. The pumping arrangement typically comprises one or more primary pumps for exhausting gas drawn from the chamber to atmosphere, and one or more secondary mechanical vacuum booster pumps connected between the primary vacuum pumps and the degassing chamber. The pumping arrangement is operated to subject the chamber to a steadily decreasing pressure (increasing vacuum), which causes gaseous and metallic impurities to leave the liquid phase and be evacuated from the atmosphere above the melt.

However, as the pressure reduces a point may be reached at which vigorous chemical reactions occur at the interface between the molten metal and the molten slag, causing a rapid generation of gas that quickly inflates the slag layer by foaming. If uncontrolled, the foaming slag can rise up and overflow from the lip of the ladle, resulting in major loss of slag and potential disruption to the purification process.

SUMMARY OF THE INVENTION

In a first aspect, the present invention provides apparatus for degassing a molten metal, the apparatus comprising a chamber for receiving a receptacle containing molten metal and a layer of slag over the molten metal, a vacuum pumping arrangement for evacuating the chamber, a gauge for outputting a signal indicative of the level of a surface of the slag, and control means for using the signal to control the rate of evacuation of the chamber to inhibit overflowing of slag from the receptacle.

The apparatus can thus enable any sudden increase in the level of the slag surface to be detected and combated by a corresponding automatic prompt reduction in the rate of evacuation of the chamber, reducing the rate at which gas is generated at the interface between the molten metal and the slag and hence the degree of foaming. Once the level of the slag surface has receded, the evacuation rate of the chamber can be increased again.

Any one of a number of different techniques may be used to provide an indication of the level of the slag surface within the receptacle. Examples include lowering a probe into the receptacle, and using a variation in an electrical property of the probe, such as inductance or resistance, to determine the level of the slag surface. A gas sensor may be used instead of a probe. Another alternative is to use a video camera to produce an image of the inside of the receptacle, and to use variations in the image as an indication of the level of the slag surface within the receptacle. In the preferred embodiment, the gauge comprises a radar transceiver for outputting a radar beam towards the slag and receiving an echo of the radar beam from the slag surface. The gauge is preferably positioned a fixed distance above the receptacle such that the period between output of the radar beam and the reception of the echo is indicative of the distance between the gauge and the slag surface, and thus the distance of the slag surface from the top of the receptacle. The signal output from the gauge may be indicative of the length of that period, with the control means being configured to control the rate of evacuation of the chamber in response thereto.

Whilst the evacuation rate of the chamber may be controlled in response to the current level of the slag surface, both the current level of the slag surface and the current rate of change of the level of the slag surface may be used to control the evacuation rate. The control means may be configured to determine the rate of change of the level of the slag surface from data contained within a plurality of signals received from the gauge over a predetermined period of time.

The control means is preferably configured to adjust the speed of rotation of at least one pump of the vacuum pumping arrangement to control the rate of evacuation of the chamber. The control means preferably comprises a pump controller for controlling the power supplied to a variable speed motor of the pump, and thus the speed of rotation of the pump. The pump controller is preferably configured to change the frequency of the power supply to the motor to adjust pump speed, for example by transmitting an instruction to an inverter to change the frequency of the power supplied thereby to the motor. However, the controller may be configured to adjust another parameter of the power supply, such as the size (or amplitude) of the voltage or current of the power supply to the motor.

In the event that a reduction in the frequency of the power supplied to the motor, or a reduction in another parameter of the power supply, does not cause the level of the slag surface to recede, the frequency of the power supplied to the motor, or said another parameter, may be reduced to zero so that the pump is effectively switched off, thereby significantly reducing the rate of evacuation of the chamber. Therefore, the control means may be configured to turn off at least one pump of the vacuum pumping arrangement in dependence on said signal. Therefore, in a second aspect the present invention provides apparatus for degassing a molten metal, the apparatus comprising a chamber for receiving a receptacle containing molten metal and a layer of slag over the molten metal, a vacuum pumping arrangement for evacuating the chamber, a gauge for outputting a signal indicative of the level of a surface of the slag, and control means for switching off at least one pump of the vacuum pumping arrangement in dependence on the signal to inhibit overflowing of slag from the receptacle.

In one arrangement, the pump controller receives directly the signals output from the gauge, and uses the signals to control the power supplied to the motor. In another arrangement, a system controller receives the signals output from the gauge, uses the signals to determine a target speed for the pump, and advises the pump controller of the target speed, for example, by advising the pump controller of the frequency of the power to be supplied to the motor. The functionality for determining the target speed can thus be provided by software stored on a single system controller, with the pump controller being responsive to the target speed received from the system controller to set its pump's speed.

In a third aspect, the present invention provides a method of degassing a molten metal, the method comprising the steps of positioning a receptacle containing the molten metal and a layer of slag over the molten metal within a chamber, evacuating the chamber, receiving from a gauge a signal indicative of the level of a surface of the slag, and using the signal to control the rate of evacuation of the chamber to inhibit overflowing of slag from the receptacle.

In a fourth aspect, the present invention provides a method of degassing a molten metal, the method comprising the steps of positioning a receptacle containing the molten metal and a layer of slag over the molten metal within a chamber, evacuating the chamber, receiving from a gauge a signal indicative of the level of a surface of the slag, and switching off at least one pump used to evacuate the chamber in dependence on the signal to inhibit overflowing of slag from the receptacle.

Features described above in relation to first aspect of the invention are equally applicable to the second to fourth aspects, and vice versa.

BRIEF DESCRIPTION OF THE DRAWINGS

Preferred features of the present invention will now be described with reference to the accompanying drawing, in which.

DETAILED DESCRIPTION OF THE INVENTION

Figure 1:
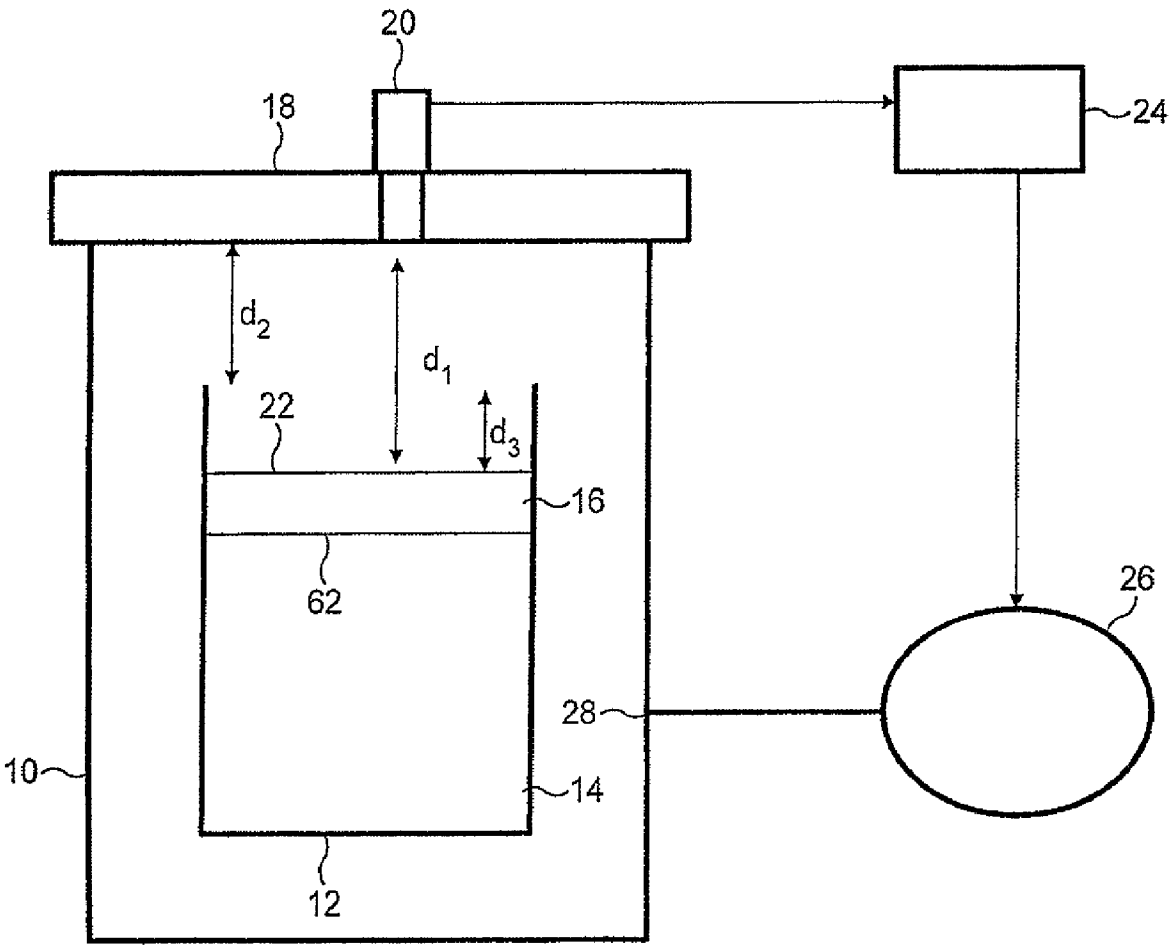
FIG. 1 illustrates a first embodiment of a steel degassing apparatus.

With reference to FIG. 1, an apparatus for degassing a molten metal, for example, molten steel, comprises a degassing chamber 10 for receiving a receptacle, or "ladle" 12, containing molten metal 14 and a layer of slag 16 overlying the molten metal 14. The chamber 10 is closed by a lid 18, on which is mounted a gauge 20 for monitoring the level of the upper surface 22 of the slag 16 within the ladle 12. In the illustrated example, the gauge 20 is in the form of a radar transceiver. The gauge 20 is connected to a controller 24 for controlling a vacuum pumping arrangement 26 connected to an outlet 28 of the chamber 10.

Figure 2:
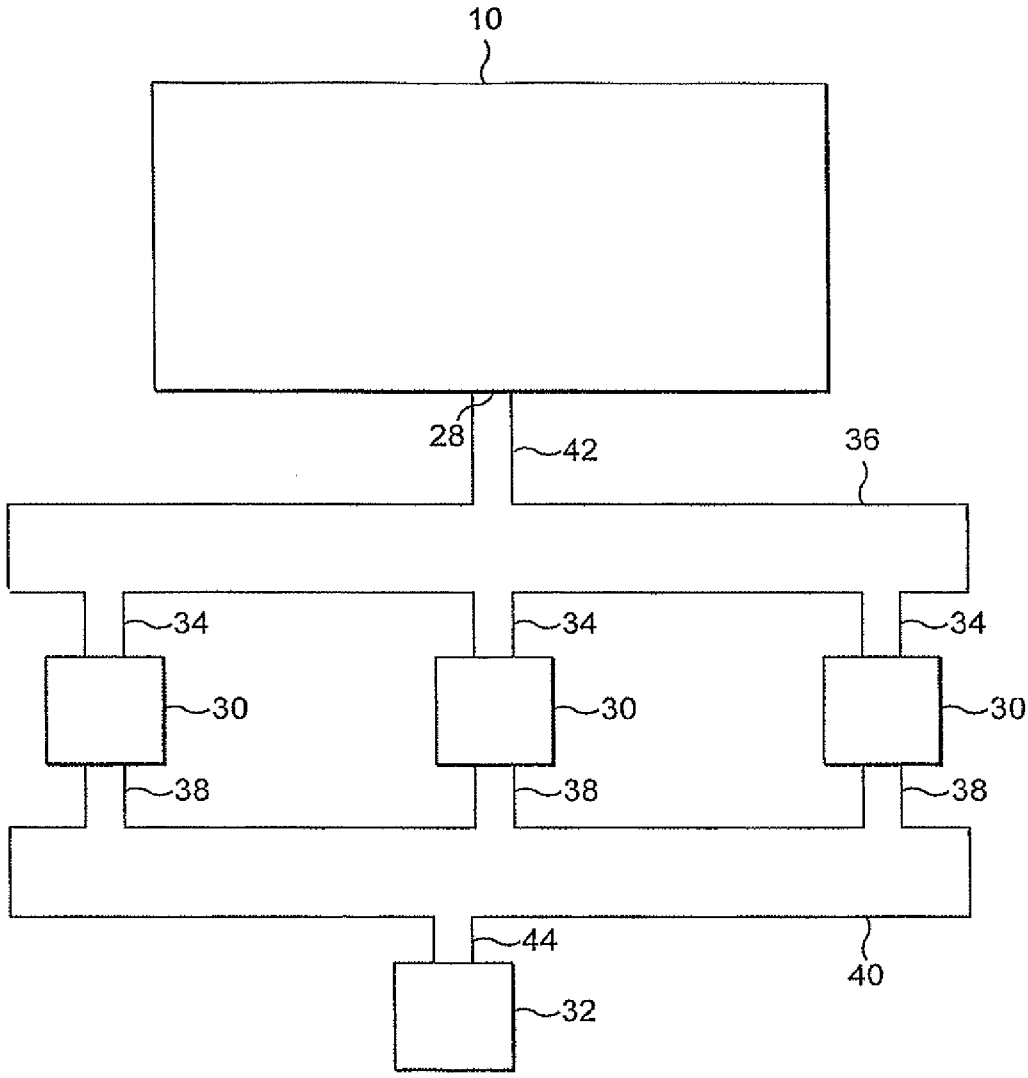
FIG. 2 illustrates an example of a vacuum pumping arrangement for evacuating the degassing chamber of the degassing apparatus of FIG. 1.

With reference now to FIG. 2, an example of the vacuum pumping arrangement 26 comprises a plurality of similar booster pumps 30 connected in parallel, and a backing pump 32. Each booster pump 30 has an inlet connected to a respective outlet 34 from an inlet manifold 36, and an outlet connected to a respective inlet 38 of an exhaust manifold 40. The inlet 42 of the inlet manifold 36 is connected to the outlet 28 from the chamber 10, and the outlet 44 of the exhaust manifold 40 is connected to an inlet of the backing pump 32. Whilst in the illustrated pumping system there are three booster pumps connected in parallel, any number of booster pumps may be provided depending on the pumping requirements of the enclosure. Similarly, where a relatively high number of booster pumps are provided, two or more backing pumps may be provided in parallel. An additional row or rows of booster pumps similarly connected in parallel may be provided as required between the first row of booster pumps and the backing pumps.

Figure 3:
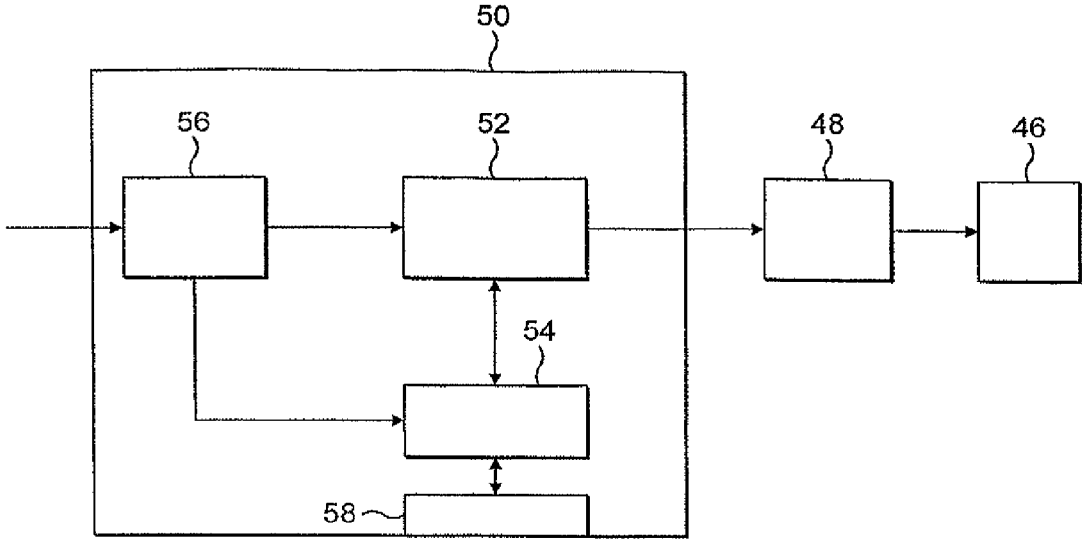
FIG. 3 illustrates a pump controller for driving a motor of a booster pump of the pumping arrangement of FIG. 2.

With reference to FIG. 3, each booster pump 30 comprises a pumping mechanism 46 driven by a variable speed motor 48. Booster pumps typically include an essentially dry (or oil free) pumping mechanism 46, but generally also include some components, such as bearings and transmission gears, for driving the pumping mechanism 46 that require lubrication in order to be effective. Examples of dry pumps include Roots, Northey (or "claw") and screw pumps. Dry pumps incorporating Roots and/or Northey mechanisms are commonly multi-stage positive displacement pumps employing intermeshing rotors in each pumping chamber. The rotors are located on contra-rotating shafts, and may have the same type of profile in each chamber or the profile may change from chamber to chamber. The backing pump 32 may have either a similar pumping mechanism to the booster pumps 30, or a different pumping mechanism. For example, the backing pump 32 may be a rotary vane pump, a rotary piston pump, a Northey, or "claw", pump, or a screw pump.

The motor 48 of the booster pump 30 may be any suitable motor for driving the pumping mechanism 46. In the preferred embodiment, the motor 48 comprises a three phase AC motor, although another technology could be used (for example, a single phase AC motor, a DC motor, permanent magnet brushless motor, or a switched reluctance motor).

A pump controller 50 drives the motor 48. In this embodiment, the pump controller 50 comprises an inverter 52 for varying the frequency of the power supplied to the AC motor 48. The frequency is varied by the inverter 52 in response to commands received from an inverter controller 54. By varying the frequency of the power supplied to the motor, the rotational speed of the pumping mechanism 46, hereafter referred to as the speed of the pump, or pump speed, can be varied. A power supply unit 56 supplies power to the inverter 52 and inverter controller 54. An interface 58 is also provided to enable the pump controller 50 to receive signals from an external source for use in controlling the pump 30, and to output signals relating to the current state of the pump 30, for example, the current pump speed, the power consumption of the pump, and the temperature of the pump.

Figure 4:
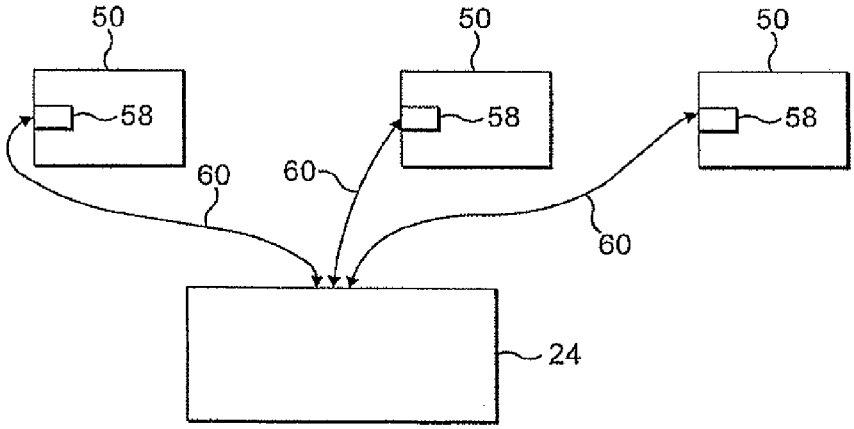
FIG. 4 illustrates the connection of the pump controllers of the booster pumps of FIG. 2 to the system controller.

In the embodiment shown in FIG. 4, the pump controllers 50 of each of the booster pumps 30 are connected to the controller 24. As illustrated, cables 60 may be provided for connecting the interfaces 58 of the pump controllers 50 to an interface of the controller 24. Alternatively, the pump controllers 50 may be connected to the controller 24 over a local area network.

In use, the vacuum pumping arrangement 26 is operated to evacuate the degassing chamber 10 to degas the molten metal 14 contained within the ladle 12. Gas is drawn from the chamber 10 into the inlet manifold 36, from which the gas passes through the booster pumps 30 into the exhaust conduit 40. The gas is drawn from the exhaust conduit 40 by the backing pump 32, which exhausts the gas drawn from the chamber 10 at or around atmospheric pressure. During evacuation of the chamber 10, the level of the surface 22 of the slag 16 is monitored using the gauge 20. The gauge outputs a radar beam towards the slag 16. The beam is first reflected from the surface 22 of the slag 16, and then from the interface 62 between the molten metal 14 and the slag 16. As a result, the gauge 20 receives a first, relatively weak echo of the radar signal after a first time period, due to the reflection of the radar beam by the surface 22 of the slag 16, and a second, relatively strong echo after a second time period, due to the reflection of the radar beam from the interface 62 between the molten metal 14 and the slag 16. The distance $d_1$ between the gauge 20 and the surface 22 of the slag 16 is proportional to the duration of the first time period. As the distance $d_2$ between the gauge 20 and the top of the ladle 12 is a constant, the distance $d_3$ between the top of the ladle 12 and the surface 22 of the slag 16 is thus also proportional to the duration of the first time period.

The gauge 20 outputs to the controller 24 a signal including, inter alia, the length, or an indication of the length, of the first time period. The controller 24 uses the data contained within the signals to monitor both the current level of the surface 22 of the slag 16 and the rate of change of the level of the surface 22, for example, due to foaming of the slag 16 during degassing. These parameters are used by the controller 24 to control the rate of evacuation of the chamber 10, which in turn controls the rate of degassing of the molten metal 14, and thus the degree of foaming of the slag 16. In this embodiment, the controller 24 varies the speeds of the booster pumps 30 to control the evacuation rate of the chamber 10 by issuing a command to the pump controllers 50 to vary the speeds of the booster pumps 30. For example, a target speed for the booster pumps 30 can be provided to the pump controllers 50 in the form of a target frequency for the inverters 52. In response to the command received from the controller 24, each pump controller 50 controls the frequency of the power supplied to its motor 32 according to the target frequency provided by the controller 24. This target frequency may be zero, so that the booster pumps 30 are effectively switched off. Alternatively, the target frequency may be progressively decreased towards zero depending on the data contained within the signals received from the gauge 20.

As a result, a rapid increase in the level of the surface 22 of the slag 16 due to foaming can be rapidly detected and combated by a corresponding automatic prompt reduction in the rate of evacuation of the chamber 10, thereby reducing the rate at which gas is generated at the interface 62 between the molten metal 14 and the slag 16 and hence preventing the slag 16 from overflowing from the ladle 12. Once the level of the slag surface 22 has receded, the evacuation rate of the chamber 10 can be increased again by issuing an appropriate command to the pump controllers 50 to increase the speeds of the booster pumps 30.

Figure 5:
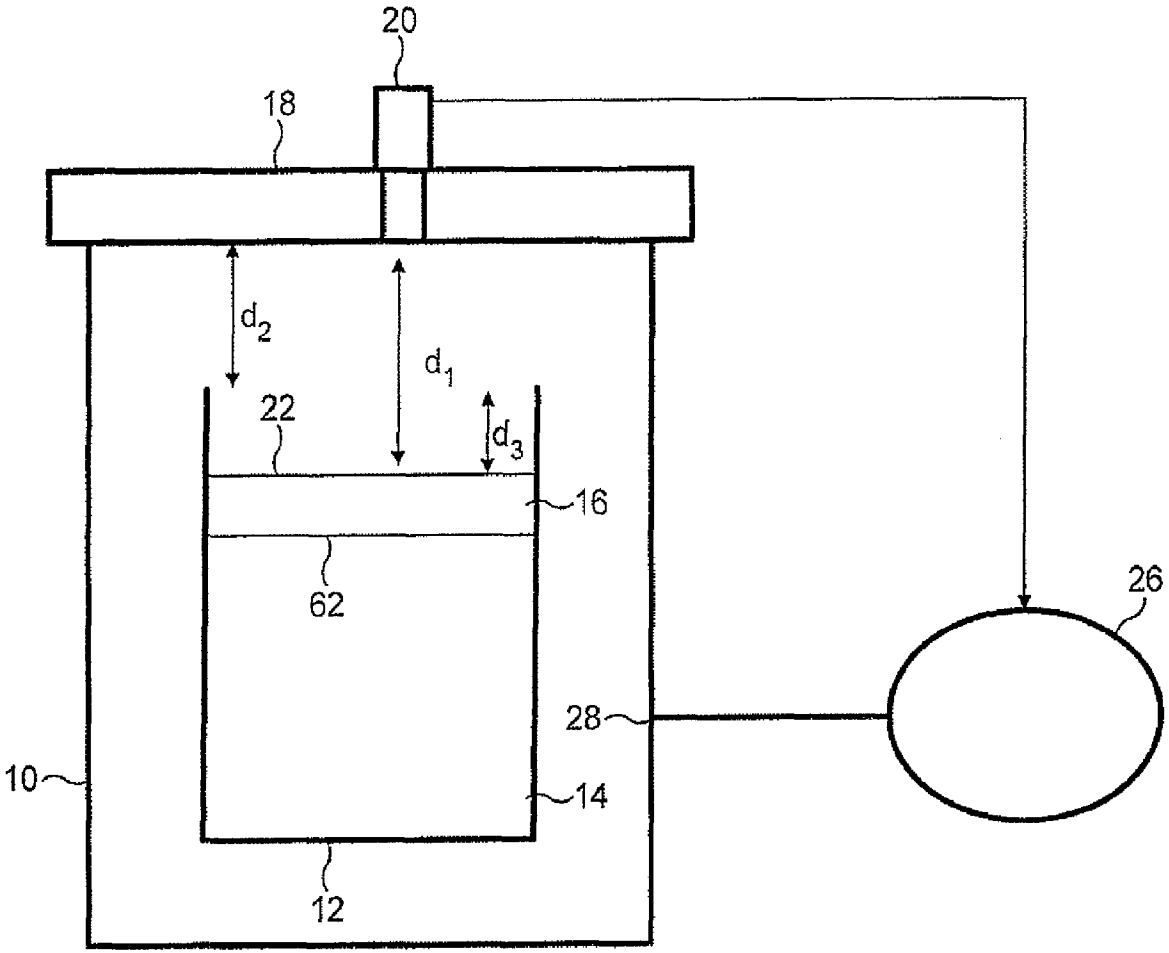
FIG. 5 illustrates a second embodiment of a steel degassing apparatus.

In the embodiment shown in FIGS. 1 to 4, a system controller 24 determines a target speed for the booster pumps 30, and advises the booster pumps 30 of the target speed. In the embodiment shown in FIG. 5, the gauge 20 is connected directly to the pumping arrangement 26. In this embodiment, the signals output from the gauge 20 are received directly by the pump controllers 50, each of which has stored therein the functionality of the controller 24 of the first embodiment for controlling the speed of its respective pumping mechanism.

The invention claimed is:

1. A method of degassing a molten metal, the method comprising the steps of positioning a receptacle containing the molten metal and a layer of slag over the molten metal within a chamber, evacuating the chamber, receiving from a gauge a signal indicative of the level of a surface of the slag, and using the signal to control the rate of evacuation of the chamber to inhibit overflowing of slag from the receptacle, wherein the rate of evacuation of the chamber is controlled by adjusting the speed of rotation of a pump used to evacuate the chamber.

2. The method according to claim 1 wherein the gauge is positioned above the receptacle, and the signal is indicative of the distance between the gauge and the slag surface.

3. The method according to claim 1 wherein the rate of evacuation of the chamber is controlled in dependence on the rate of change of the level of the slag surface.

4. The method according to claim 3 wherein the rate of evacuation of the chamber is controlled in dependence on both the level of the slag surface and the rate of change of the level of the slag surface.

5. The method according to claim 1 wherein the speed of the pump is adjusted by varying a power or current supplied to a variable speed motor for driving the pump.

6. The method according to claim 5 wherein the frequency of the power supply to the motor is varied to adjust pump speed.

7. The method according to claim 1 wherein the pump is switched off to control the rate of evacuation of the chamber.

* * * * *